US010323377B2

(12) United States Patent
Powers, III

(10) Patent No.: US 10,323,377 B2
(45) Date of Patent: Jun. 18, 2019

(54) METHOD AND APPARATUS FOR EMPLACING STEEL COLUMNS

(71) Applicant: John Powers, III, Phoenix, AZ (US)

(72) Inventor: John Powers, III, Phoenix, AZ (US)

( * ) Notice: Subject to any disclaimer, the term of this patent is extended or adjusted under 35 U.S.C. 154(b) by 0 days.

(21) Appl. No.: 15/817,857

(22) Filed: Nov. 20, 2017

(65) Prior Publication Data

US 2018/0142437 A1 May 24, 2018

Related U.S. Application Data

(60) Provisional application No. 62/424,708, filed on Nov. 21, 2016, provisional application No. 62/429,704, filed on Dec. 2, 2016.

(51) Int. Cl.
*E02D 7/18* (2006.01)
*E04B 1/24* (2006.01)

(52) U.S. Cl.
CPC ..... *E02D 7/18* (2013.01); *E04B 1/24* (2013.01); *E02D 2250/00* (2013.01); *E04B 2001/2463* (2013.01); *E04B 2103/06* (2013.01)

(58) Field of Classification Search
CPC ..... E02D 7/18; E02D 2250/00; E04B 1/24; E04B 2001/2463; E21B 7/20
USPC ..... 52/169.9
See application file for complete search history.

(56) References Cited

U.S. PATENT DOCUMENTS 2,214,295 A * 9/1940 De Biasi ..... E02D 13/10 173/130
3,530,947 A * 9/1970 Gendron ..... E02D 1/04 175/55
4,018,056 A * 4/1977 Poma ..... E02D 5/36 405/233
4,190,118 A * 2/1980 Sweeney ..... E02D 13/10 173/130
4,262,755 A * 4/1981 Kuhn ..... E02D 7/10 173/131
4,436,452 A * 3/1984 Bodine ..... E02D 7/18 173/49
4,479,552 A * 10/1984 Chappelow, Jr. ..... E02D 13/10 173/131
4,565,251 A * 1/1986 Cischke ..... E02D 13/10 173/128
4,614,070 A * 9/1986 Idland ..... E04H 12/2253 52/295
5,088,564 A * 2/1992 Kobayashi ..... E02D 7/10 173/1
5,256,006 A * 10/1993 Harding ..... E04H 12/2284 173/130
5,653,556 A * 8/1997 White ..... E02D 7/18 173/162.1
7,080,958 B1 * 7/2006 Morris ..... E02D 7/18 173/162.1
9,255,375 B2 * 2/2016 Yingling ..... E02D 7/02
2017/0335538 A1 * 11/2017 Lindeman ..... E02D 7/18

* cited by examiner

*Primary Examiner* — Paola Agudelo

(74) *Attorney, Agent, or Firm* — Parsons & Goltry; Robert Parsons; Michael Goltry

(57) ABSTRACT

A sonic drilling apparatus with adapter for emplacing columns includes a sonic drilling apparatus having a fitting. An adapter is coupled to the fitting. The adapter includes a base having a socket extending upwardly therefrom and coupled to the fitting, and a coupling mechanism extending downwardly from the base. A tubular polygonal column is removably attached to the adapter by the coupling mechanism.

6 Claims, 5 Drawing Sheets

METHOD AND APPARATUS FOR EMPLACING STEEL COLUMNS

CROSS-REFERENCE TO RELATED APPLICATION

This application claims the benefit of U.S. Provisional Application No. 62/424,708, filed 21 Nov. 2016 and U.S. Provisional Application No. 62/429,704, filed 2 Dec. 2016.

FIELD OF THE INVENTION

This invention relates to construction equipment and methods.

More particularly, the present invention relates to methods and equipment for emplacing columns in a surface.

BACKGROUND OF THE INVENTION

In the field of construction, emplacing columns for a structure, such parking shade structures, requires a great deal of labor. The columns must be properly positioned, a hole must be dug to receive the column, the column inserted into the hole and the hole backfilled. While backfilling, the column must remain properly positioned, and the backfill must be strong enough to support the column and structure of which it is a part. The time and effort needed to emplace columns is substantial, resulting in high costs for this kind of construction.

It would be highly advantageous, therefore, to remedy the foregoing and other deficiencies inherent in the prior art.

An object of the present invention is to provide apparatus and method for quickly and easily emplacing columns.

SUMMARY OF THE INVENTION

Briefly, to achieve the desired objects and advantages of the instant invention, provided is a sonic drilling apparatus with adapter for emplacing columns. Included is a sonic drilling apparatus having a fitting. An adapter is coupled to the fitting. The adapter includes a base having a socket extending upwardly therefrom and coupled to the fitting, and a coupling mechanism extending downwardly from the base. A tubular polygonal column is removably attached to the adapter by the coupling mechanism.

Also provided is a method of emplacing a tubular column including providing a sonic drilling apparatus having a fitting, and an adapter including a base having a socket extending upwardly therefrom, and a coupling mechanism extending downwardly from the base. Attaching the adapter to a tubular polygonal column with the coupling mechanism. Coupling the socket to the fitting, and driving the tubular polygonal column vertically into a supporting substrate to a depth desired and sufficient to provide stability to the tubular polygonal column employed for the construction of a structure.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
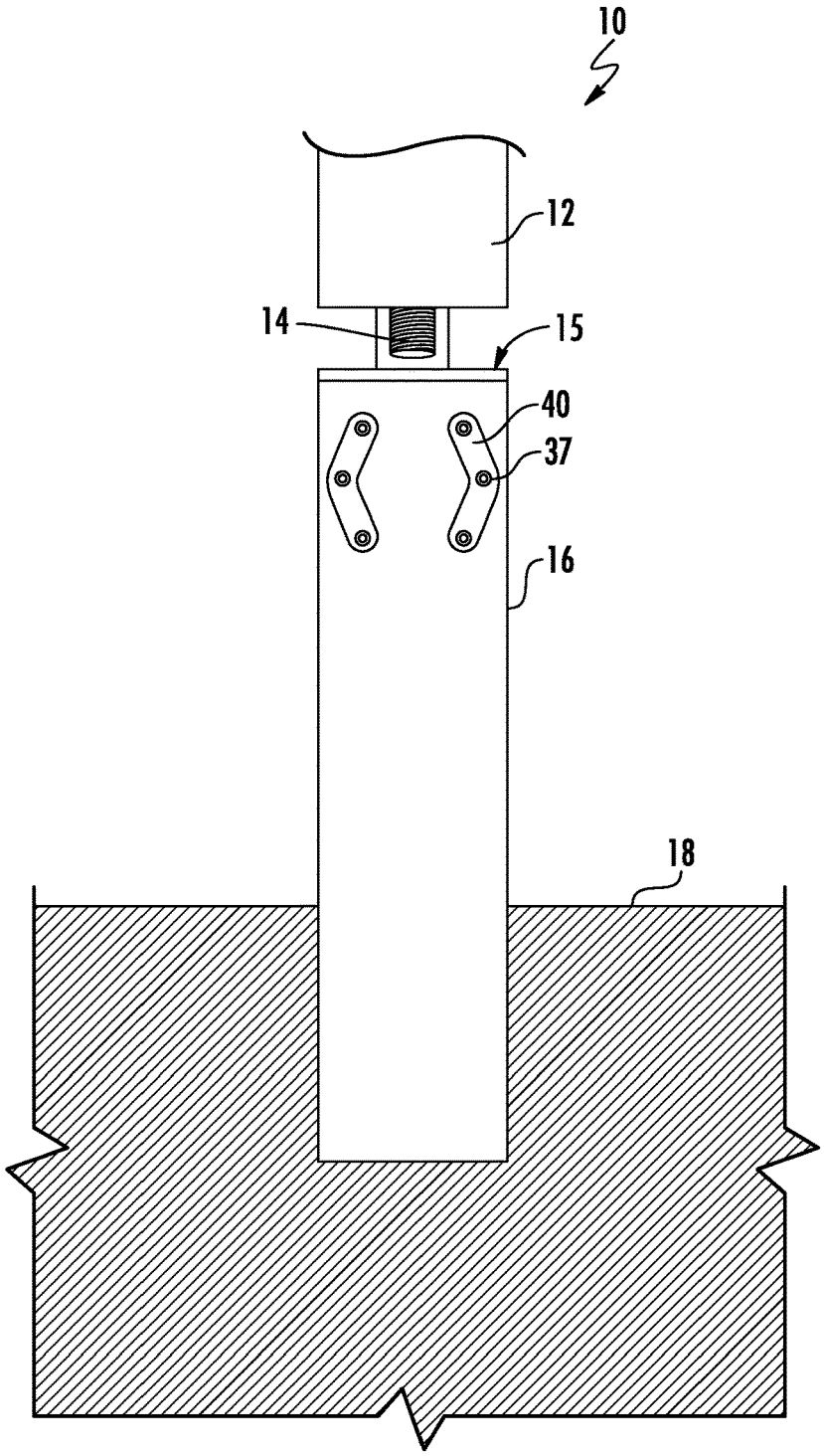
FIG. 1 is a partial simplified schematic of a sonic drilling apparatus and column according to the present invention.

Turning now to the drawings in which like reference characters indicate corresponding elements throughout the several views, attention is directed to FIG. 1 which illustrates a sonic drilling apparatus generally designated 10. Sonic drilling apparatus 10 will not be described in detail, as it is well known in the art, and includes an orbiting mass oscillator 12, or like mechanism for causing vibrational waves, having a threaded fitting 14 to which drill casings have been conventionally attached. An adapter 15, according to the present invention, is provided for use in attaching a tubular polygonal column 16 to sonic drill apparatus 10. While substantially any polygonal column can be employed, square or rectangular tubular columns are preferred. In particular, a tubular column made from the joining of two C-shaped elements is preferred. The tubular column preferably employed is disclosed in U.S. Pat. No. 9,394,689, issued Jul. 19, 2016, and incorporated herein by reference.

Sonic drilling apparatus 10 is utilized to drive column 16 into a supporting substrate 18 such as earth. In operation, column 16 can be driven through typical soil, concrete, asphalt and other substrates 18. By using resonant sonic drilling methods an oscillator is adapted to transmit sinusoidal pressure waves through column 16 to create a cutting action at the lower edge. The pressure waves are typically created by two counter-rotating, offset balance roller weights each having an eccentric axis located in the orbiting mass oscillator 12. Frequencies close to the natural frequency of column 16 are generated, thereby causing the column to vibrate elastically along its longitudinal axis. In the resonant condition, the column stores and releases energy, thereby generating large forces between the lower edge and the substrate. It will be understood that sonic drilling apparatus 10 can be carried by a drill vehicle, mounted on a tripod or other structure, and the like. These structures carrying sonic drilling apparatus 10 allow for transportation of apparatus 10 as well as accurate placement of column 16.

Figure 2:
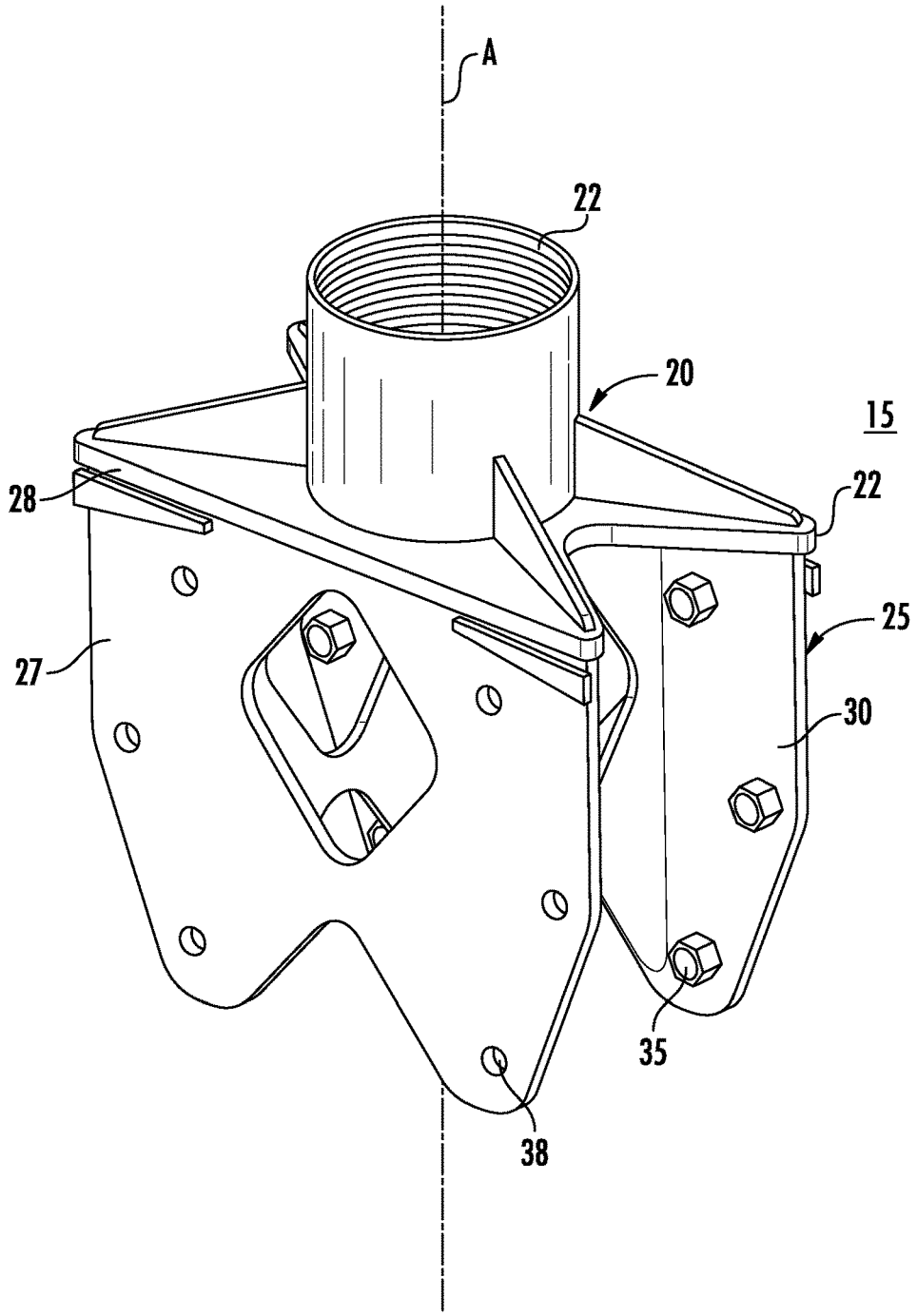
FIG. 2 is a perspective view of an adapter for attaching a column to a sonic drilling apparatus according to the present invention.

Turning now to FIG. 2, adapter 15 is illustrated. Adapter 15 includes a base 20 having a threaded socket 22, couplable to threaded fitting 14, extending upwardly from one side and a coupling mechanism 25 extending downwardly from the opposing side along an axis A. It will be understood that while a threaded fitting is preferred, other fittings for allowing coupling of adapter 15 can be employed, such as quick connect fasteners, bayonet style couplings, mating flanges bolted together, and the like. Coupling mechanism 25 includes a plate 27 extending from an edge 28 of base 20 parallel to axis A, and a plate 30 extending from an edge 32 of base 20 parallel to axis A. Plate 27 and plate 30 are parallel and spaced apart with respect to one another, and sized to be received within the top end of column 16.

Figure 3:
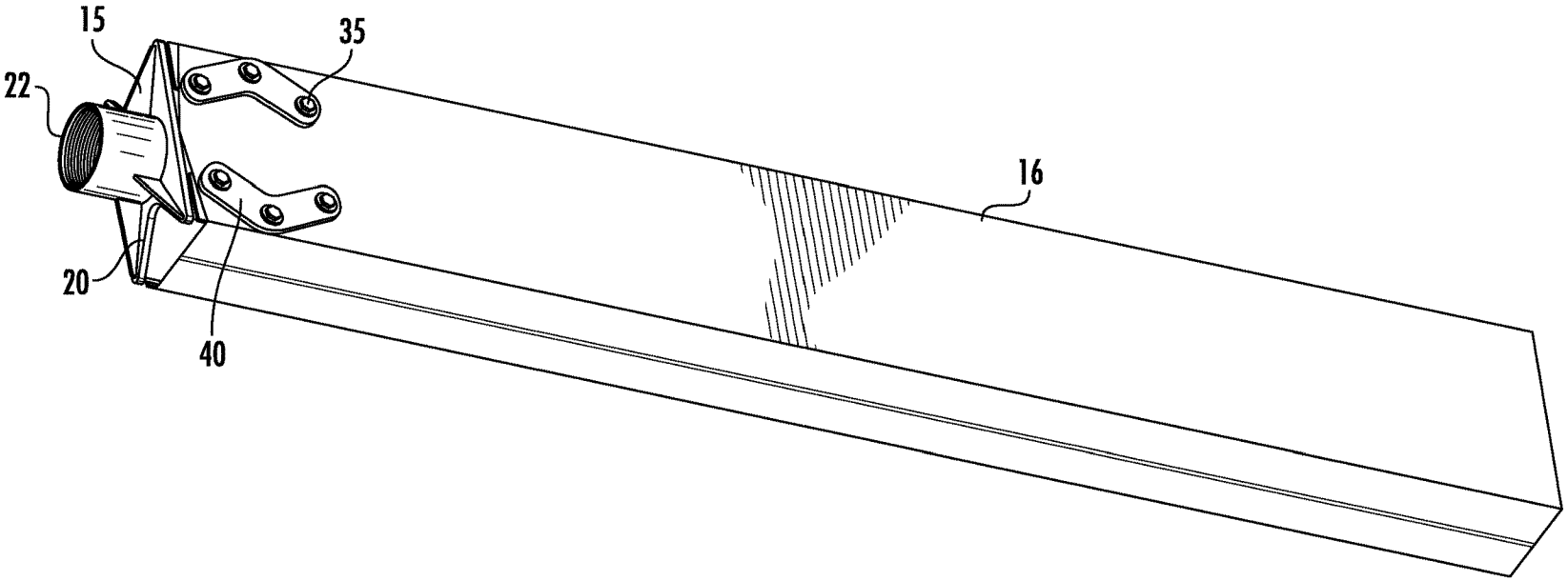
FIG. 3 is a perspective view of an adapter attached to a column for attachment to a sonic drilling apparatus according to the present invention.

With additional reference to FIG. 3, when received within column 16, plate 27 and plate 30 lie against opposing sides thereof and are fixed in position by fasteners 35 extending concurrently through apertures 37 in the sides of column 16 and apertures 38 formed in plates 27 and 30. Brackets 40 are positioned on the outer surface of the sides of column 16 to reinforce the sides of column 16 and act as washers to prevent damage to column 16.

In operation, a column 16 is coupled to adapter 15. Adapter 15 is then coupled to orbiting mass oscillator 12 by attachment to threaded fitting 14. Column 16 is then positioned over the location in which it is to be emplaced, and using the sonic drilling apparatus, driven vertically into the substrate to a depth desired and sufficient to provide stability to column 16. Column 16 is not rotated, but simply driven vertically downward. Column 16 is then employed as a column for the construction of a structure such as a parking structure, shade structure, building and the like. By employing sonic drill technology to emplace columns, holes need not be dug, and filler need not be replaced after positioning the column. The column is simply inserted through the substrate, which closely engages the column preventing removal thereof without the additional use of the sonic drill apparatus. Column 16 is driven into the substrate when the correct frequency is achieved for the material of the column to resonate.

To achieve an emplaced column, column 16 is at least 128 thousandths of an inch thick and preferably in the range of 128 to 150 thousandths of an inch thick. The material of column is steel being a high strength steel in the range of 85-100 KSI. The thickness and hardness scales are required to prevent welds forming column 16 from tearing loose, and to prevent the forces generated by sonic drilling apparatus 10 from damaging column 16.

Figure 4:
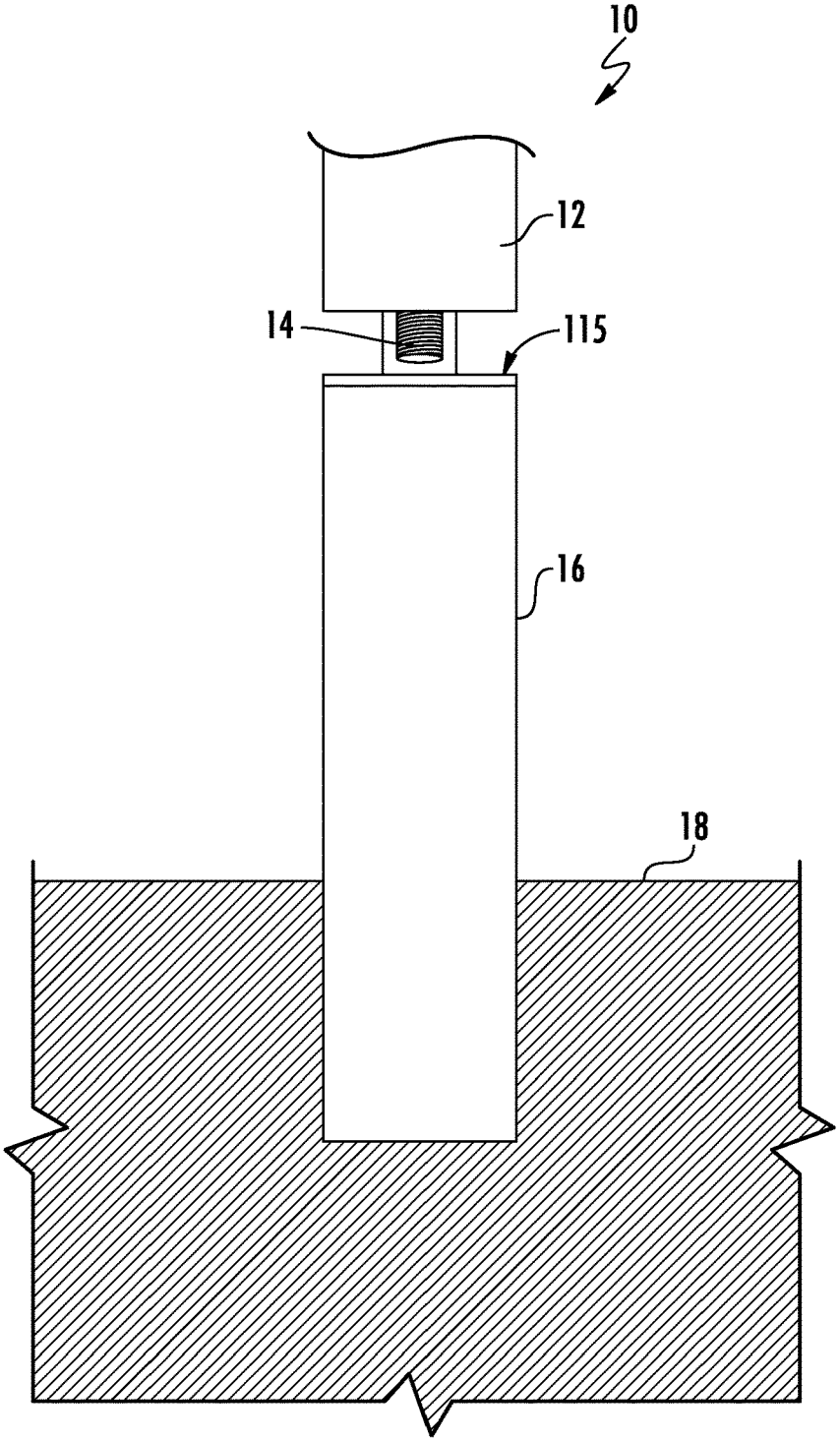
FIG. 4 is a partial simplified schematic of a column coupled to a sonic drilling apparatus by another embodiment of an adapter according to the present invention.

Turning now to FIG. 4, illustrated is sonic drilling apparatus 10 which includes orbiting mass oscillator 12 having a threaded fitting 14, to which drill casings have been conventionally attached, and another embodiment of an adapter 115. As with adapter 15, adapter 115 is provided for use in attaching tubular polygonal column 16 to sonic drill apparatus 10. As discussed previously, while substantially any polygonal column can be employed, square or rectangular tubular columns having opposed planar surfaces are preferred. Sonic drilling apparatus 10 with adapter 115 is utilized in the same manner as with adapter 15 described previously.

Figure 5:
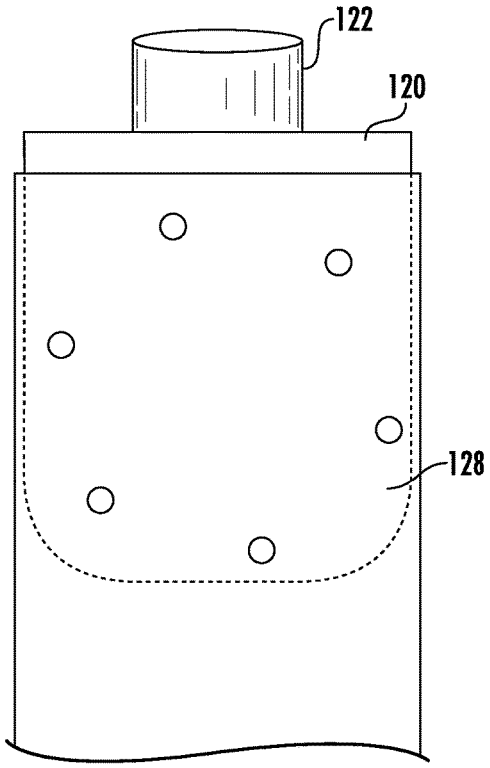
FIG. 5 is a side view of an adapter for attaching a column to a sonic drilling apparatus according to the present invention.
Figure 6:
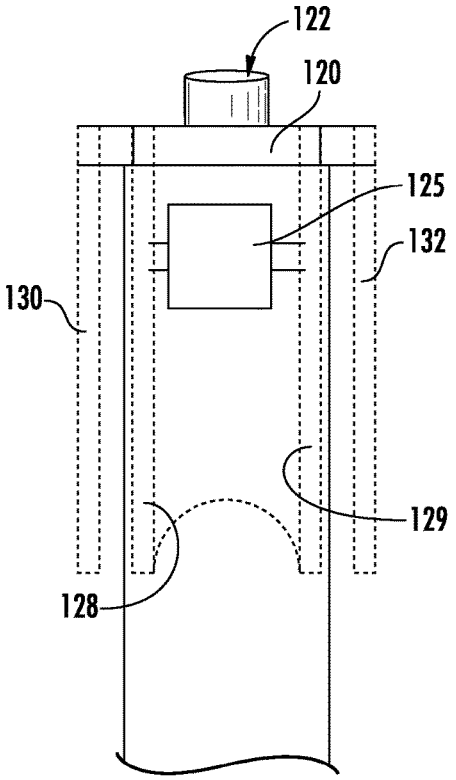
FIG. 6 is a sectional side view of an adapter attached to a column for attachment to a sonic drilling apparatus according to the present invention.

Turning now to FIGS. 5 and 6, adapter 115 is illustrated. Adapter 15 includes a base 120 having a threaded socket 122, couplable to threaded fitting 14, extending from one side and carrying an expansion mechanism such as a hydraulic cylinder 125. While a hydraulic cylinder is preferred, other expansion mechanisms such as pneumatic cylinders, mechanical wedges and the like, can be employed. Hydraulic cylinder 125 is employed to drive at least one and preferably two opposing plates 128 and 129 between an engaged position and a disengaged position. In operation, adapter 115, with plates 128 and 129 in the disengaged position, is inserted into the top end of column 16 with plates 128 and 129 positioned adjacent inner surfaces of opposing sidewalls of column 16. Hydraulic cylinder 125 is then actuated to move plates 128 and 129 outwardly to the engaged position. In the engaged position, plates 128 and 129 are pressed against the inner surfaces of column 16, securely holding adapter 115 to column 16. In this manner, column 16 is securely retained by adapter 115 which is then couple to sonic drilling apparatus 10, allowing the vibrations to pass into column 16.

Still referring to FIG. 6, plates 128 and 129 can be replaced by or augmented with opposing plates 130 and 132 positioned outside column 16. If desired, when replacing plates 128 and 129 with plates 130 and 132, the sides of column 16 can be supported by stationary plates such as plates 27 and 30 of adapter 15 positioned inside column 16. In both cases, whether replacing or augmenting plates 128 and 129, and whether or not inside plate are used, the expansion mechanism is employed to drive opposing plates 130 and 132 between an engaged position and a disengaged position. In operation, adapter 115, with plates 130 and 132 in the disengaged position, is inserted onto the top end of column 16 with plates 130 and 132 positioned adjacent outer surfaces of opposing sidewalls of column 16. Hydraulic cylinder 125 is then actuated to move plates 130 and 132 inwardly to the engaged position. In the engaged position, plates 130 and 132 are pressed against the outer surfaces of column 16, securely holding adapter 115 to column 16.

Referring to FIGS. 5 and 6, when received within column 16, plates 128 and 129 lie against opposing sides thereof and are fixed in position by the pressure generated by the expanded hydraulic cylinder. In this manner, column 16 can be quickly released from engagement by adapter 115 and can be quickly engaged by adapter 115. With adapter 115 engaged with column 16, adapter 115 is then coupled to orbiting mass oscillator 12 by attachment to threaded fitting 14. Column 16 can then be positioned over the location in which it is to be emplaced, and using the sonic drilling apparatus, driven into the substrate to a depth desired and sufficient to provide stability to column 16. Column 16 is then employed as a column for the construction of a structure such as a parking structure, shade structure, building and the like. By employing sonic drill technology to emplace columns, holes need not be prepared, and filler need not be replaced after positioning the column. The column is simply inserted through the substrate, which closely engages the column preventing removal without the additional use of the sonic drill apparatus. Column 16 is driven into the substrate when the correct frequency is achieved for the material of the column to resonate.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. Sonic drilling apparatus with adapter for emplacing columns comprising:

a tubular polygonal column having an end;

a sonic drilling apparatus having a fitting; and an adapter coupled to the fitting, the adapter including a base having a socket extending upwardly therefrom and coupled to the fitting, and an insert extending downwardly from the base and received inside the end of the tubular polygonal column.

2. Sonic drilling apparatus with adapter as claimed in claim 1 wherein the insert extending downwardly from the base and received inside the end of the tubular polygonal column includes a pair of parallel plates extending from the base and engaging opposing sides of the tubular polygonal column.

3. Sonic drilling apparatus with adapter as claimed in claim 2 wherein the pair of parallel plates are movable between an engaged position, pressing against opposing sides of the tubular polygonal column and a disengaged position, by an expansion mechanism coupled to the base.

4. Sonic drilling apparatus with adapter as claimed in claim 3 wherein the pair of movable plates are moved outwardly for pressing against inner surfaces of the opposing sides of the tubular polygonal column.

5. Sonic drilling apparatus with adapter as claimed in claim 2 wherein the pair of parallel plates extending from the base engaging opposing sides of the tubular polygonal column are fastened to inner surfaces of the opposing sides of the tubular polygonal column.

6. Sonic drilling apparatus with adapter as claimed in claim 1 wherein the tubular polygonal column is fabricated of sheet steel having a thickness in a range of 128 to 150 thousandths of an inch and being a high strength steel in the range of 85-100 KSI.

* * * * *